US005605408A

United States Patent [19]

Su

[11] Patent Number: 5,605,408

[45] Date of Patent: Feb. 25, 1997

[54] REPLACABLE LIPSTICK TUBE WITH A CLAMPING SEAT

[76] Inventor: Cheng-Yuan Su, P.O. Box 438, Hsinchu City, Taiwan

[21] Appl. No.: 559,065

[22] Filed: Nov. 16, 1995

[51] Int. Cl.[6] ..... A45D 40/06

[52] U.S. Cl. ..... 401/78; 401/86

[58] Field of Search ..... 401/78, 86

[56] References Cited

U.S. PATENT DOCUMENTS

| | | | |
|---|---|---|---|
| 3,146,881 | 9/1964 | Metreaud et al. | 401/86 X |
| 3,653,776 | 4/1972 | Geisel | 401/86 |
| 3,758,218 | 9/1973 | Pfrommer | 401/86 |
| 4,738,559 | 4/1988 | Gueret | 401/86 X |
| 4,961,663 | 10/1990 | Iwamoto et al. | 401/78 |
| 5,000,601 | 3/1991 | Wruck | 401/78 |

FOREIGN PATENT DOCUMENTS

| | | | |
|---|---|---|---|
| 2244475 | 4/1991 | United Kingdom | 401/78 |
| 9316615 | 9/1993 | WIPO | 401/78 |

*Primary Examiner*—Steven A. Bratlie
*Attorney, Agent, or Firm*—Bacon & Thomas

[57] ABSTRACT

The lipstick tube includes a replaceable lipstick seat and a housing. The lipstick seat has an inner tube which has a lower outer rim provided with at least a toothed ring while a base of the housing is provided with a clamping seat. The clamping seat has curved urging plates for clamping the inner tube inserted thereinto to a suitable extent. The lipstick seat may be secured within the base of the housing and may be lifted out of or lowered into the lipstick tube.

3 Claims, 6 Drawing Sheets

REPLACABLE LIPSTICK TUBE WITH A CLAMPING SEAT

BACKGROUND OF THE INVENTION

1. Field of the Invention

The present invention relates generally to a lipstick tube, and more particularly to a lipstick tube with a replaceable lipstick seat, wherein a plurality of lipstick seats may be used in conjunction with a single lipstick tube to save manufacturing costs and reduce waste.

2. Description of the Prior Art

Lipsticks are common cosmetic items. Once a lipstick is used up, the lipstick tube and the housing are discarded though they may not have any wear. Moreover, since lipstick tubes and housings are generally made of electroplated plastic or metallic materials, disposal of large quantities of lipstick tubes and housings not only is wasteful, but also aggravates environmental pollution. Furthermore, as lipstick tubes and housings occupy a considerable percentage of the total manufacturing costs, it is irrational to dispose of the still usable lipstick tube and housing once the consumable lipstick is used up.

SUMMARY OF THE INVENTION

A primary object of the present invention is to provide a lipstick tube structure with a replaceable lipstick seat which may be replaced once the lipstick is used up so that the lipstick tube and its housing may continue to be used, hence reducing waste of materials and minimizing environmental pollution.

Another object of the present invention is to provide a lipstick tube structure for use with a plurality of lipsticks of different colors so as to provide variety and enhance the value of lipstick products.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
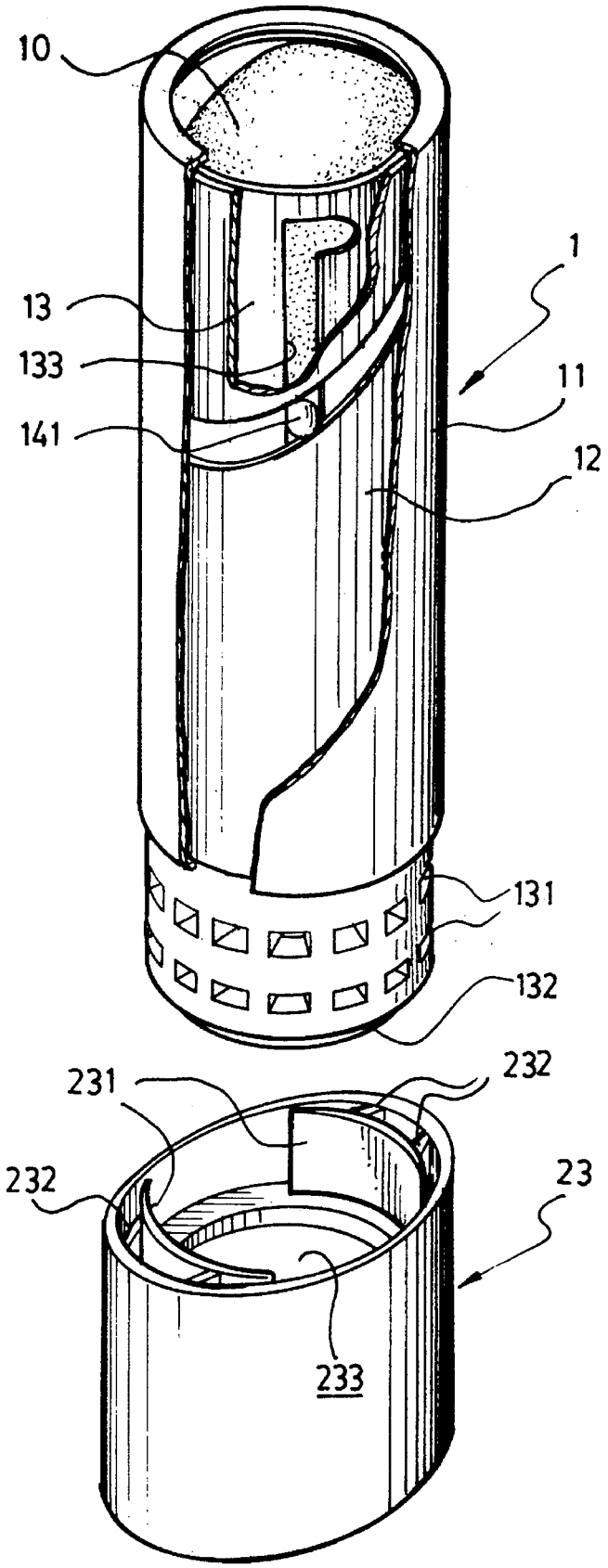
FIG. 1 is an exploded perspective view of a lipstick seat and a clamping seat according to the present invention.
Figure 2:
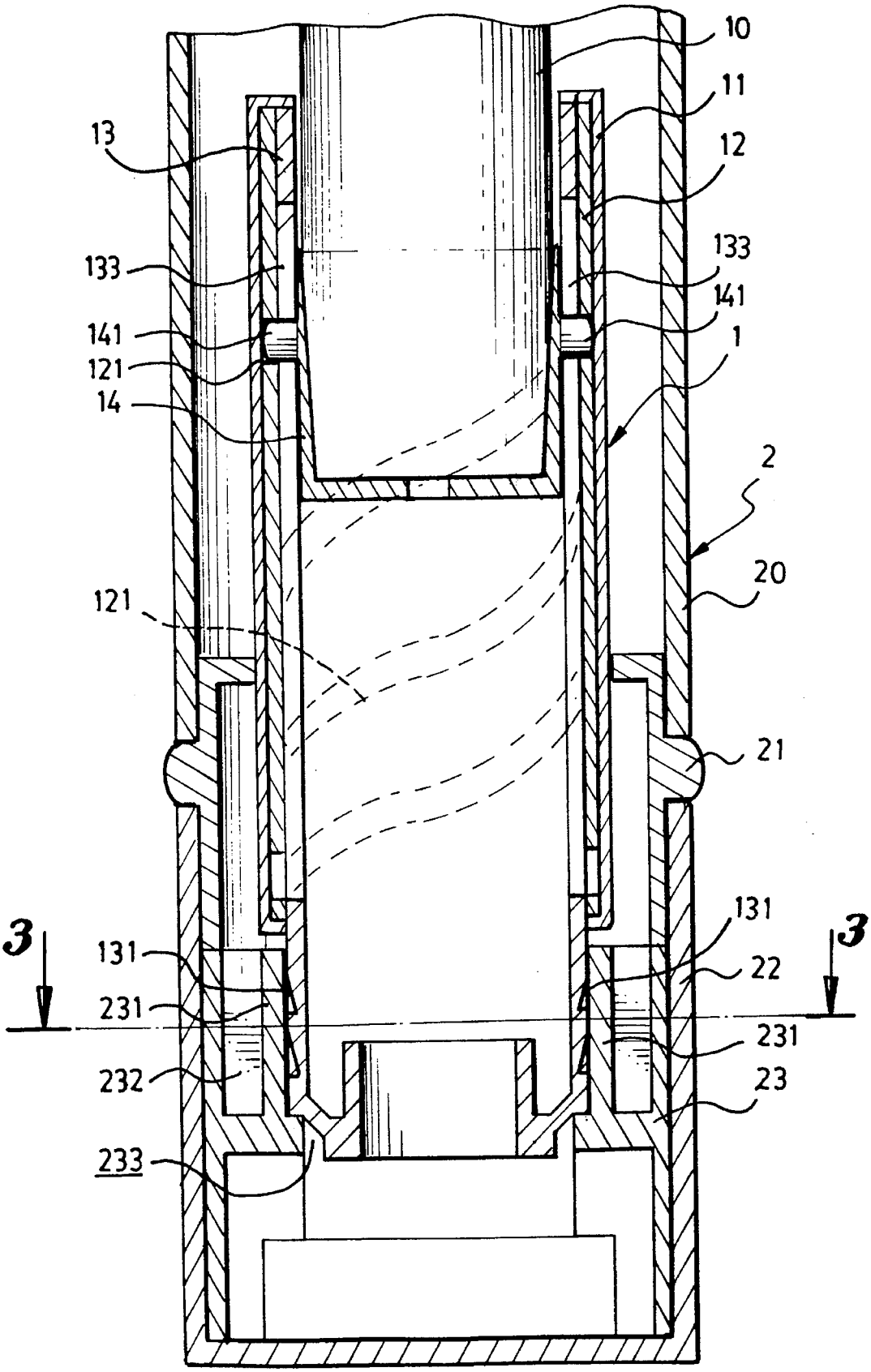
FIG. 2 is a longitudinal sectional view of a lipstick tube according to the present invention.

With reference to FIGS. 1 and 2, the lipstick tube according to the present invention comprises a lipstick seat 1 consisting of an outer tube 11, an intermediate tube 12, an inner tube 13, an elevating seat 14 and a lipstick 10 supported on the elevating seat 14. The outer tube 11 is firmly secured with the intermediate tube 12 which is provided with a spiral groove 121 in its inner wall. The inner tube 13 enveloped by the intermediate tube 12 is in a rotary relationship with the intermediate tube 12 and is provided with a vertical slot 133. The elevating seat 14 has a pair of projections 141 projecting from both outer sides thereof. The projections 141 penetrate the vertical slot, 133 and the spiral groove 121. When the inner tube 13 and the intermediate tube 12 turn relative to each other, the spiral groove 121 will cause the projections 141 to displace upwardly or downwardly along a track defined thereby, so that the lipstick 10 may be lifted upwardly out of the outer tube 11 for application or lowered inside the inner tube 11 for storage. Such an arrangement is commonly found in prior lipstick tubes.

In the present invention, the inner tube 13 has a bottom portion thereof extending downwardly to form a guide piece 132 at an extreme end thereof. The extended bottom portion of the inner tube 13 is further provided with at least a toothed ring 131. A clamp seat 23 is provided to match the toothed ring 131 and has two curved urging plates 231 provided on opposite sides of an inner wall thereof. The urging plates 231 are supported by ribs 232 on the inner wall. The ribs 232 provide a suitable elasticity for the two urging plates 231 which together define an insert slot 233 for receiving and positioning the inner tube 13.

Figure 3:
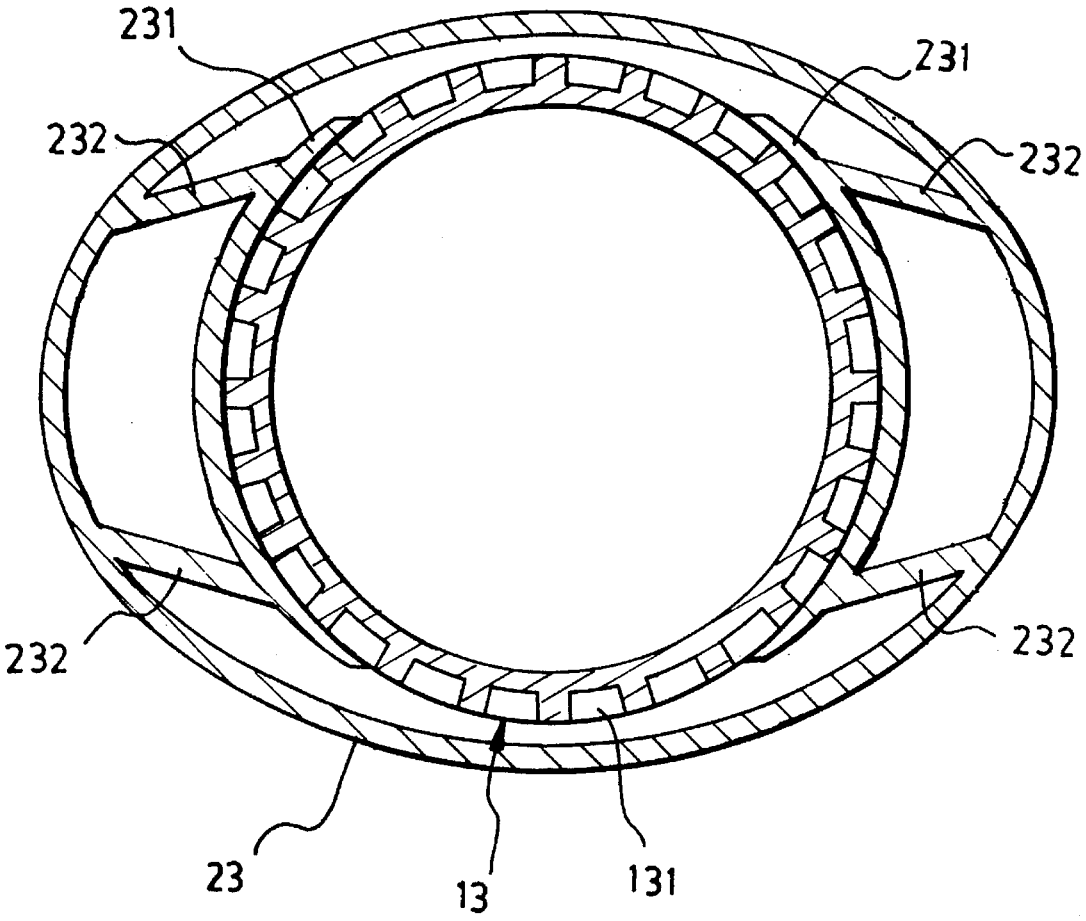
FIG. 3 is a horizontal sectional view of the lipstick seat and the clamping seat according to the present invention.

As shown in FIG. 2, the present invention further comprises a housing 2 consisting of a cap 20, a decorative ring 21, and a base 22. The above-mentioned clamp seat 23 is located within the base 22, and the lipstick seat 1 is inserted into the insert slot 233 of the clamp seat 23 via the lower end of the inner tube 13 such that the lipstick seat 1 may be inserted or removed from the clamp seat 23 with ease. Once the lipstick seat 1 is inserted into the insert slot 233, the toothed ring 131 and the urging plates 231 will rub against each other in an axial direction. With reference to FIG. 3, the contact between the toothed ring 131 and the curved urging plates 231 is not smooth since the urging plates 231 are made of elastic material (such as plastics) such that, when the urging plates 231 and the toothed ring 131 press against each other, interfering friction will be generated. As a result, when the base 22 is turned, the clamp seat 23 will be brought to force the inner tube 13 to turn therewith, causing the inner tube 13 and the intermediate tube 12 to perform relative rotation, thereby the projections 141 on the elevating seat 14 are caused to be displaced upwardly or downwardly due to the action of the vertical slot 133 and the spiral groove 121. The lipstick 10 may then be lifted out of the outer tube 11 or lowered into the lipstick seat 1.

With reference to FIG. 2, when the outer tube 11 grips the base 22 and rotates the lipstick seat 1, the inner tube 13 will not synchronously rotate with the outer tube 11 since its bottom portion is insertably retained by the clamp seat 23, while the intermediate tube 12 secured to the outer tube 11 will rotate therewith. The projections 141 will then be guided along the spiral groove 121 of the intermediate tube 12 to displace upwardly or downwardly in the vertical slot 133 (as in the prior art) and to control the upward or downward movement of the lipstick 10.

A major feature of the present invention resides in the cooperative relationship between the inner tube 13 and the clamp seat 23, in particular, the cooperation among the toothed ring 131 and guide piece 132 of the inner tube 13 and the insert slot 233 and the curved urging plates 231 of the clamp seat 23. The effects achievable by the present invention are that the lipstick seat 1 may be mounted on or disengaged from the clamp seat 23; that the guide piece 132 at the bottom of the inner tube 13 enables the inner tube 13 to be easily inserted into the insert slot 233 of the clamp seat 23; and that once the inner tube 13 is held in the insert slot 233, it is firmly secured therein by means of the frictional action of the toothed ring 131 and the urging plates 231. When the lipstick seat 1 and the base 22 rotate in a relative relationship, the inner tube 13 may be gripped to be prevented from rotating with the outer tube 11, forcing the elevating seat 14 carrying the lipstick 10 to displace upwardly or downwardly.

Figure 5:
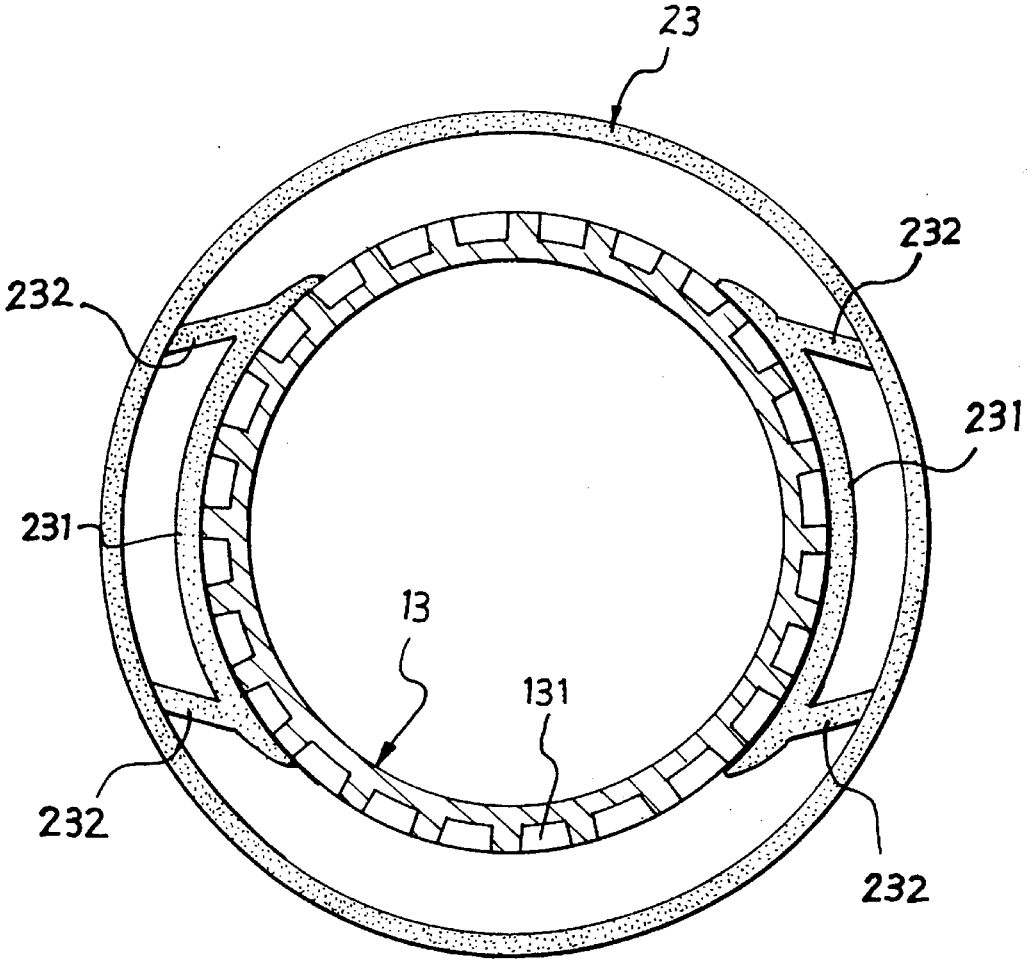
FIG. 5 is another preferred embodiment of the present invention.
Figure 6:
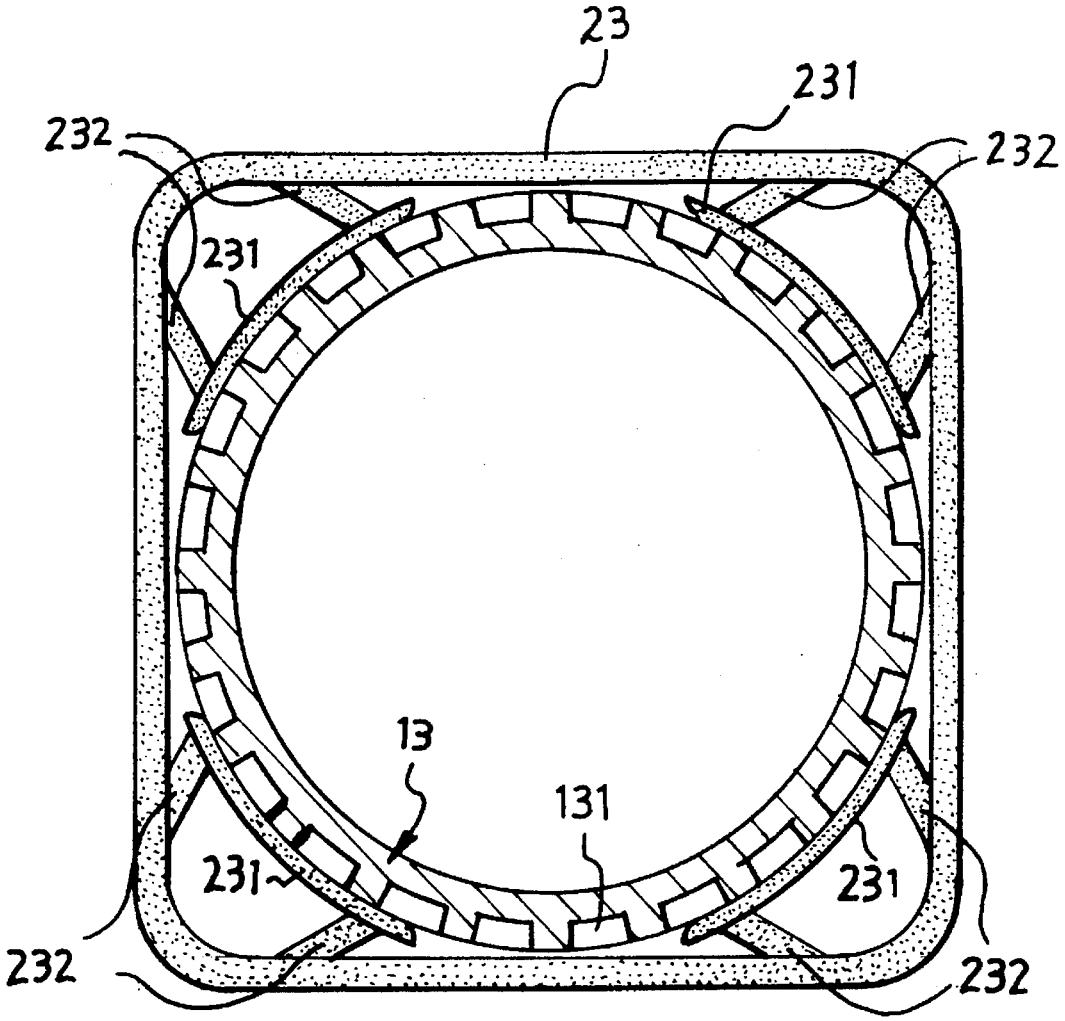
FIG. 6 is a further preferred embodiment of the present invention.

According to the feature of the present invention, the relationship between the toothed ring 131 of the inner tube 13 and the urging plates 231 of the clamp seat 23 is illustrated by the embodiments in FIGS. 5 and 6, which show the clamp seat 23 to be a circular or rectangular structure, being different from the elliptical one shown in FIGS. 1 and 3. The clamp seat 23 may be configured to be a circular or rectangular tube structure in order to match bases of various shapes. In FIGS. 3 and 5, the urging plates 231 are structures disposed on both sides of the clamp seat 23, but they may also be configured to be disposed at the four corners of a rectangular clamp seat 23.

Figure 4:
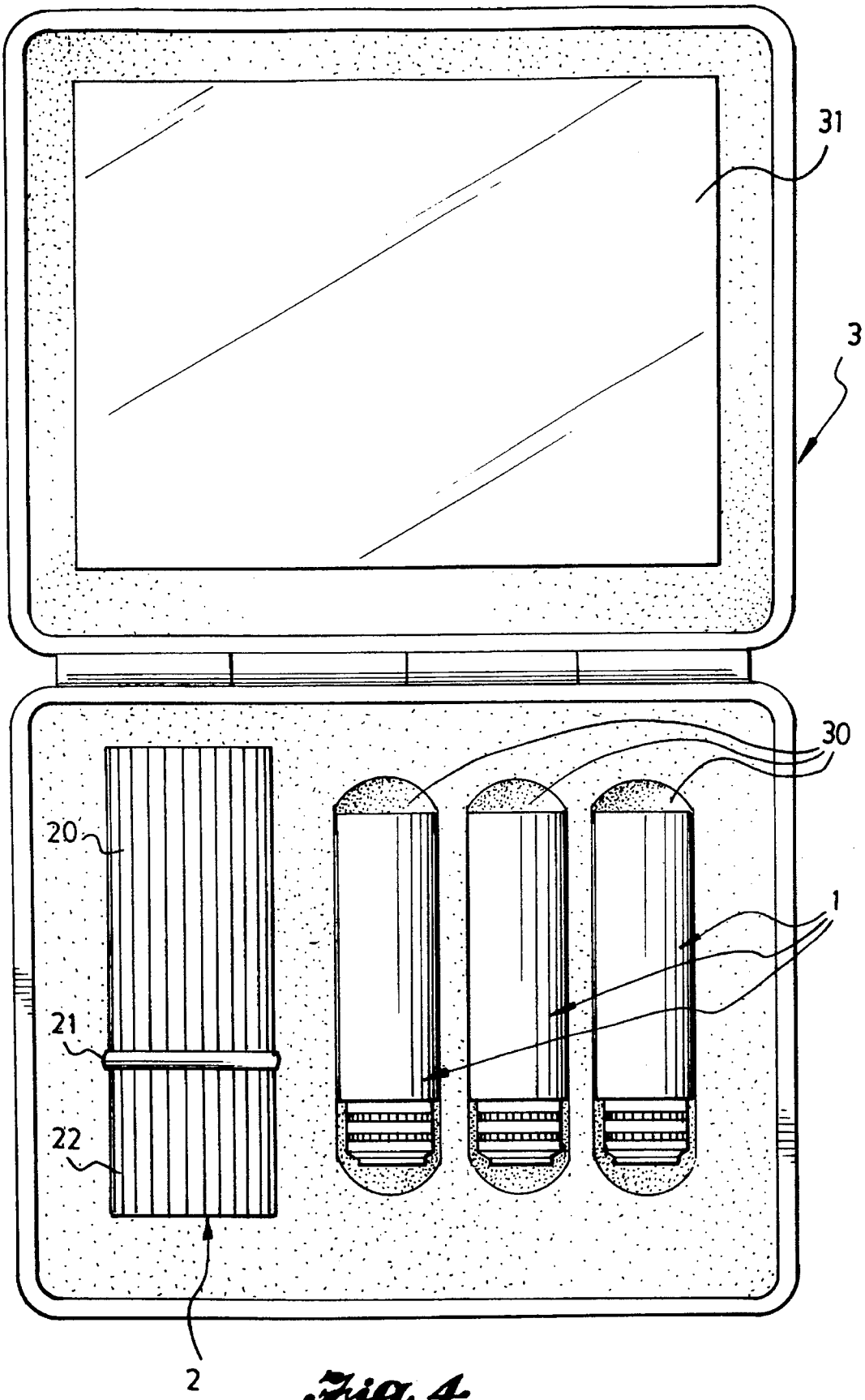
FIG. 4 is the lipstick seat and a housing according to the present invention in an assembled state.

In view of the convenient mounting and disengagement of the lipstick seat from the lipstick tube according to the present invention, lipstick manufacturers may produce the housing 2 and the lipstick seat 1 separately or even sell them separately, reducing manufacturing costs and waste. FIG. 4 shows a lipstick kit 3 provided with a mirror 31 and containing one housing 2 and a plurality of lipstick seats 1. Such a lipstick kit 3 provides lipsticks of various colors, hence increasing the value of the product.

In view of the foregoing, the lipstick tube of the present invention not only increases the value of lipstick products and lowers costs but also helps to reduce necessary waste.

Although the present invention has been illustrated and described with reference to the preferred embodiment thereof, it should be understood that it is in no way limited to the details of such embodiment but is capable of numerous modifications within the scope of the appended claims.

What is claimed is:

1. A lipstick tube structure with a replaceable lipstick seat, comprising:

a lipstick seat assembly supporting a lipstick and comprising an outer tube, an intermediate tube located within and attached to said outer tube, the intermediate tube having an inner wall provided with a spiral groove, and a rotatable inner tube rotatably disposed within said intermediate tube and having a vertical slot said inner tube of said lipstick tube having a lower section thereof extending outside of said outer tube to form an extended section provided with a toothed ring having a multiplicity of indentations, said inner tube further having a bottom rim provided with a convergingly tapered guide piece; and an elevating seat located within said inner tube for supporting the lipstick, said elevating seat provided with at least one projection extending from an outer wall thereof and penetrating said vertical slot and said spiral groove, said elevating seat being caused by said spiral groove to rise or lower along said vertical slot when said inner tube and said intermediate tube are relatively rotated; and a housing comprising a cap, a decorative ring, a base and a clamping seat located in said base, wherein said clamping seat is made of an elastic material having an inner wall with a plurality of ribs projecting from opposite sides of the inner wall thereof, said ribs connected to concavely curved urging plates which collectively define an insert slot such that said urging plates elastically press inwardly, against sides of said lower section of said inner tube so that said urging plates frictionally contact said toothed ring.

2. The lipstick tube as claimed in claim 1, wherein said curved urging plates of said clamping seat comprise two curved plates disposed on opposite sides of the inner wall of said clamping seat.

3. The lipstick tube as claimed in claim 1, whereas said curved urging plates of said clamping seat comprise four curved plates disposed at four corners of the inner wall of said clamping seat.

* * * * *